United States Patent [19]

Desjardins

[11] Patent Number: 4,998,696

[45] Date of Patent: Mar. 12, 1991

[54] PAINT CAN CADDY

[76] Inventor: Warren Desjardins, 18 Bonita Rd., East Quogue, N.Y. 11942

[21] Appl. No.: 442,919

[22] Filed: Nov. 29, 1989

Related U.S. Application Data

[63] Continuation-in-part of Ser. No. 258,010, Oct. 14, 1988.

[51] Int. Cl.[5] ..... A47G 23/02

[52] U.S. Cl. ..... 248/146; 220/90; 248/176; 248/346

[58] Field of Search ..... 248/146, 152, 154, 127, 248/346, 678, 510, 316.2, 310, 314, 176; 220/20, 69, 70, 90

[56] References Cited

U.S. PATENT DOCUMENTS

| | | | |
|---|---|---|---|
| 1,450,632 | 4/1923 | Horton | 220/69 |
| 2,650,786 | 9/1953 | Platt | 248/154 X |
| 3,407,429 | 10/1968 | Nardo | 248/110 X |
| 3,409,932 | 11/1968 | George | 248/110 X |
| 3,414,311 | 12/1968 | Trimboli | 248/210 X |
| 3,980,264 | 9/1976 | Tomasik | 248/110 X |
| 4,890,807 | 1/1990 | Desjardins | 248/146 |

*Primary Examiner*—Ramon O. Ramirez

*Attorney, Agent, or Firm*—Richard L. Miller

[57] ABSTRACT

A paint can caddy having a removable top panel with a channeled rim fitting on a hollow base unit, the panel top containing a molded, raised circular lip and a plurality of concentric, circular platforms formed within said circular lip adapted to securely hold a can of paint. The top panel may be used alone or with a base unit which is typically but not necessarily rectangular and may contain an opening in at least one sidewall for permitting the storage of painters equipment therein.

6 Claims, 1 Drawing Sheet

PAINT CAN CADDY

This application is a Continuation In Part of a copending application Ser. No.: 07/258,010, filed Oct. 14, 1988, now U.S. Pat. No. 4890807 entitled LIQUID TOOL CADDY, for which a continuous chain of copendency has been maintained.

BACKGROUND OF THE INVENTION

1. FIELD OF THE INVENTION

This invention relates to an inexpensive plastic caddy useful to painters. A typically rectangular base unit has a top panel containing a plurality of molded platforms for securely holding paint cans thereon. The base is hollow and has typically one open side wall useful to permit either painting implements to be stored therein and/or to facilitate clamping the device to a supporting surface. The top panel is removable for us independently of the base.

2. DESCRIPTION OF THE PRIOR ART

There are numerous devices known in the art that are adapted to securely hold an opened paint can to prevent inadvertent tipping and thereby avoid spilling of the paint. Likewise there are numerous caddy devices adapted to store painting tools or the like. None of the prior art teaches a device useful for both purposes, and which further provides for removal of the paint can holding portion for use independently of the storage portion.

An object of this invention is a combination paint can holder and paint tool storage device.

Another object of this invention is an inexpensive plastic paint can caddy having a top portion adapted to securely hold an opened paint can, and usable in conjunction with a hollow base for storing painting equipment, or useful alone on a flat supporting surface.

A still further object of this invention is a paint can caddy adapted to securely hold paint cans of various sizes.

BRIEF DESCRIPTION OF THE DRAWING FIGURES

The figures in the drawings are briefly described as follows.

SUMMARY OF THE INVENTION

This invention relates to an inexpensive plastic paint can caddy having a removable top panel with a channeled rim adapted to fit securely on a hollow base unit. The top panel contains a molded circular projection forming a platform for securely holding a can of paint. Additional circular platforms of decreasingly smaller size may be formed at lower levels in the top panel for holding smaller diameter paint cans. A plurality of wedge-shaped extrusions may be molded into the side walls of each platform to hold the paint can securely. The removable top panel may be used without the hollow base unit on a flat supporting surface, where it may be optionally secured to such by clamping. The hollow base unit has at least one open side wall into which painter's equipment may be stored, and legs may be attached to the bottom corners of the hollow base unit.

DESCRIPTION OF THE PREFERRED EMBODIMENT

Figure 2:
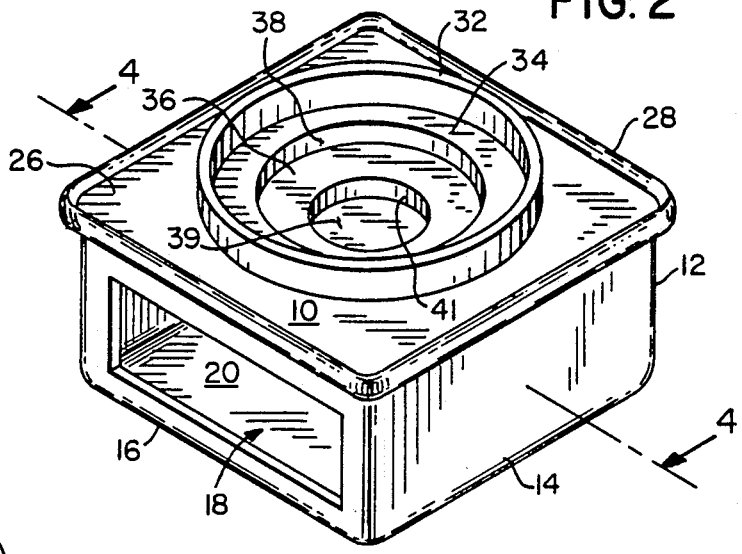
FIG. 2 is an enlarged perspective view thereof per se.

Referring particularly to FIG. 2, the paint can caddy comprises a top panel 10 adapted to securely hold an opened paint can, and a base unit 12. Both the top panel 10 and the base unit 12 may be constructed from a material such as plastic, and each may me molded in one piece.

Figure 4:
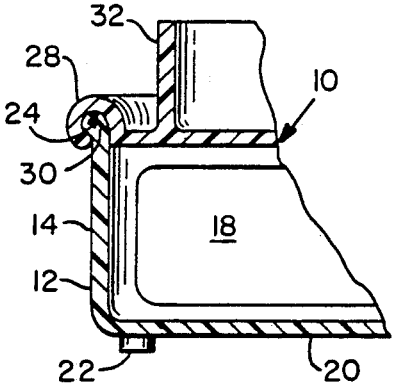
FIG. 4 is a cross-sectional view taken along line 4—4 of FIG. 2.

The base unit 12 is rectangular and has three solid walls 14 and a wall 16 containing an opening 18. A floor 20 is connected to each of the walls. As shown best in FIG. 4, legs 22 may be attached at each bottom corner of floor 20. The base unit 12 is useful for storing painting materials therein by placing them within the unit through wall opening 18. The top of each wall 14 and 16 may be formed into a beaded lip 24 as shown best in FIG. 4, the beaded lip 24 extending around the entire top perimeter of the base unit 12.

Figure 3:
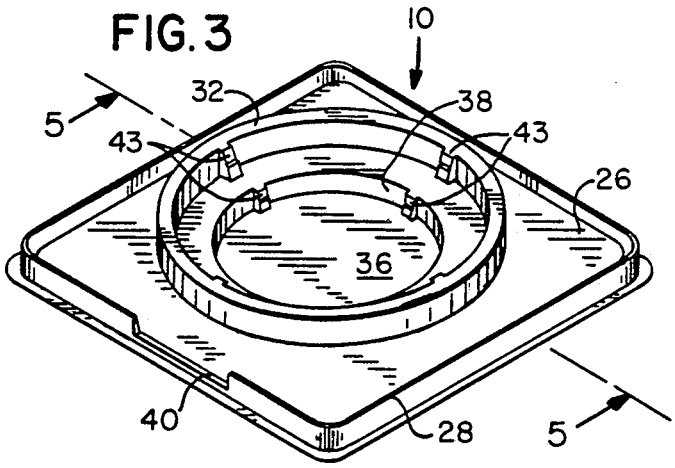
FIG. 3 is an enlarged perspective view similar to FIG. 2 of a second embodiment of the invention.

In one embodiment the top panel 10 is constructed to fit securely on the bottom unit 12 as shown in FIG. 2, or in a second embodiment the top panel 10 may be used alone as best seen in FIG. 3. In both embodiments the top panel 10 has a floor or flat surface 26 adapted to catch paint drops or overflow from a paint can, and a raised outer perimeter fence 28. The raised perimeter fence 28 has a channel 30 formed in its underside (see FIG. 4) which is adapted to fit over the beaded lip 24 of bottom unit 12. This construction assures a secure fit between the top portion 10 and bottom unit 12.

Figure 5:
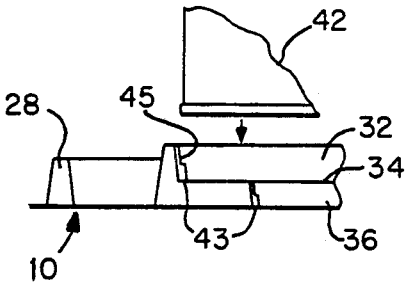
FIG. 5 is a diagrammatic cross-sectional view taken along line 5—5 of FIG. 3 with a portion broken away showing a portion of a paint can about to be positioned thereon.

Molded as part of top panel 10 or attached to floor or flat surface 26 is a raised circular lip 32 which has attached symmetrically therewithin a flat first platform 34 for holding a can of paint. A second platform 36 having walls 38 is formed by a circular indentation or depression symmetrical within the first platform 34. A third platform 39 with side walls 31 may be located platforms 36 and 39 are useful to hold cans of paint with smaller diameters. Only the first and second platforms 34 and 36 are shown in FIGS. 3 and 5.

As shown in FIG. 3, a plurality of wedge-shaped extrusions 43 may be located symmetrically on the inside of circular lip 32 and on inside wall 38. The extrusions 43 press against the outside of the paint cans to hold frictionally engage them securely in place on the platforms and prevent spillage of the paint. The extrusions 43 preferably are sufficiently flexible to be pressed inward when a paint can 42 (see FIG. 5) is pushed against them, thus holding the paint can securely within the circular platform. The extrusions 43 are also preferably formed such that a step 45, best seen in FIG. 5, is formed approximately in the middle of each extrusion.

Shown in FIG. 3 is an optional cut-away portion of raised outer perimeter 28 shown at 40 to facilitate the clamping of the top panel 10 to a flat supporting surface so that the top panel 10 can be used to secure paint cans independently of a bottom unit 12.

Figure 1:
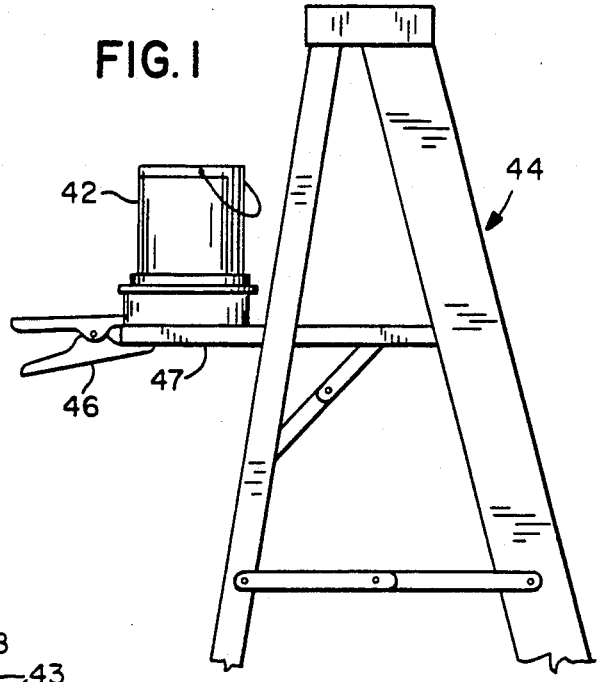
FIG. 1 is a perspective view of a first embodiment of the invention illustrated installed of a stepladder and ready for use.

FIG. 1 shows the combined top panel 10 and bottom unit 12 holding a can of paint 42 on a ladder 44. A clamp 46 is shown securing the paint can caddy to the shelf 47 of the ladder 44.

FIG. 5 shows the paint can 42 as it is lowered into the embodiment of top panel 10 of FIG. 3.

It is to be noted that for the purpose of illustration the instant invention has been generally represented as rectangular in shape however it might just as well be circular, hexagonal octagonal, n-sided polygonal or a host of other shapes to numerous to mention without departing scope of the invention.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A paint can caddy comprising:

(a) a base unit containing a flat floor and having a side wall extending vertically from the perimeter of the floor with at least one opening in said side wall of sufficient size to permit access within said base unit, the tip perimeter of said side wall having a beaded lip; and (b) a top panel adapted to fit securely on the top of said base unit, the underside of said top panel having a channeled rim about the perimeter thereof adapted to fit integrally over the beaded lip, said top panel having a circular lip extending upwardly a short distance and attached symmetrically therewithin a first annular platform for holding a can of paint and a circular depression symmetrical within said first platform forming a second annular platform having a perimetrical wall for supporting a can of paint of a smaller diameter than may be supported by said first platform.

2. A paint caddy as in claim 1 and further including a plurality of wedge-shaped extrusions about the inside of said circular lip and the wall of said second platform and extending a short distance inwardly for contacting the sides of a paint can located on said first or second platforms and holding said paint can securely.

3. A paint can caddy as in claim 1 and including a second circular walled depression forming a third platform located symmetrically within said second platform.

4. A paint can caddy as in claim 1 in which said base unit is rectangular and in which the said sidewall has four wall portions, said one opening in the sidewall being in one of said wall portions.

5. A paint can caddy as in claim 4 in which said top panel is rectangular and includes a raised edge about the perimeter of the four sides of said top panel.

6. A paint can caddy as in claim 5 and including a gap in the raised edge on one of the four sides of said rectangular top panel.

* * * * *